US008141546B2

(12) United States Patent
Liu

(10) Patent No.: US 8,141,546 B2
(45) Date of Patent: Mar. 27, 2012

(54) BOWSTRING DRAWING ASSEMBLY FOR A BOW

(75) Inventor: Chang Chi Liu, Fengyuan (TW)

(73) Assignee: Poe Lang Enterprises Co., Ltd., Fengyuan (TW)

( * ) Notice: Subject to any disclaimer, the term of this patent is extended or adjusted under 35 U.S.C. 154(b) by 368 days.

(21) Appl. No.: 12/588,553

(22) Filed: Oct. 20, 2009

(65) Prior Publication Data

US 2011/0088677 A1 Apr. 21, 2011

(51) Int. Cl.
*F41B 5/14* (2006.01)

(52) U.S. Cl. ..... 124/1; 124/86

(58) Field of Classification Search ..... 124/1, 23.1, 124/80, 86, 88
See application file for complete search history.

(56) References Cited

U.S. PATENT DOCUMENTS 5,370,103 A * 12/1994 Desselle ..... 124/86
6,932,070 B1 * 8/2005 Kurtz, Jr. ..... 124/1
7,185,644 B2 * 3/2007 Kurtz, Jr. ..... 124/1
7,255,099 B2 * 8/2007 Henry ..... 124/1

* cited by examiner

*Primary Examiner* — John Ricci
(74) *Attorney, Agent, or Firm* — Bacon & Thomas, PLLC

(57) ABSTRACT

A bowstring drawing assembly for a bow has a mounting frame, an operating device and a connecting belt. The mounting frame has a bottom bar, two supporting shafts and two pulleys. The supporting shafts are connected to the bottom bar. The pulleys are connected to the supporting shafts to hold the bow. The operating device is mounted on the mounting frame and has a holding seat, a rotating rod, a worm wheel, a worm shaft and a crank shaft. The holding seat is mounted on the bottom bar. The rotating rod is rotatably connected to the holding seat. The worm wheel is mounted around the rotating rod. The worm shaft is rotatably connected to the holding seat and engages the worm wheel. The crank shaft is connected securely to the worm shaft. The connecting belt is connected to the rotating rod of the operating device to mount around the bow.

7 Claims, 5 Drawing Sheets

BOWSTRING DRAWING ASSEMBLY FOR A BOW

BACKGROUND OF THE INVENTION

1. Field of the Invention

The present invention relates to a bowstring drawing assembly for a bow, and more particularly to a bowstring drawing assembly for a bow that can be operated easily and has a simple structure with low costs.

2. Description of Related Art

A conventional bowstring drawing assembly for a bow comprises a mounting frame, at least one winch device and a transmitting device. The at least one winch device is mounted on the mounting frame. The linking device is connected to the at least one winch device. When using the conventional bowstring drawing assembly for adjusting a bowstring of the bow, putting the bow on the mounting frame and rotating the at least one winch device, the transmitting device will move relative to the mounting frame to bend the two limbs of the bow. Then, the bowstring can be adjusted. However, rotating the at least one winch device is laborious and the conventional bowstring drawing assembly further needs a non-return device to prevent the at least one winch device from reversing.

Another conventional bowstring drawing assembly for a bow comprises a mounting frame, a piston cylinder, two struts and two arms. The piston cylinder is mounted on the mounting frame and has a piston rod. The struts are pivotally connected to the piston rod of the piston cylinder. The arms are respectively connected to the struts opposite to the piston rod. When using the conventional bowstring drawing assembly for adjusting the bowstring of the bow, putting the bow on the mounting frame and starting the piston cylinder. Then, the struts will move relative to the mounting frame by the piston rod and the arms that connected to the struts will bend the limbs of the bow. However, the piston rod of the piston cylinder has a fixed stroke and this will limit the bending range of the limbs of the bow.

Furthermore, other conventional bowstring drawing assembly for a bow comprises a mounting frame, an operating device and a transmitting device. The operating device has a threaded rod and operating handle. The threaded rod is movably connected to the mounting frame and has a first bevel gear. The operating handle is rotatably connected to the first bevel gear of the threaded rod by a second bevel gear. The transmitting device is connected to the threaded rod. When adjusting the bowstring of the bow, putting the bow on the mounting frame and rotating the operating handle to make the threaded rod moving relative to the mounting frame by the engagement of the bevel gears. Then, the transmitting device will move relative to the mounting frame to bend the limbs of the bow by the operating device. The operating device of the conventional bowstring drawing assembly also can be a hoisting jack or a gear wheel-rack device.

Although the conventional bowstring drawing assembly can provide a bowstring adjusting effect, but the conventional bowstring drawing assemblies for a bow aforementioned have a complicated structure and this will make the assembling troublesome and will increase the cost of production. Furthermore, mounting and locating the bow on the conventional bowstring drawing assembly is inconvenient.

To overcome the shortcomings, the present invention tends to provide a bowstring drawing assembly for a bow to mitigate or obviate the aforementioned problems.

SUMMARY OF THE INVENTION

The main objective of the invention is to provide a bowstring drawing assembly for a bow that can be operated easily and has a simple structure with low costs.

The bowstring drawing assembly in accordance with the present invention for a bow having two limbs and a bowstring and has a mounting frame, an operating device and a connecting belt. The mounting frame has a bottom bar, two supporting shafts and two pulleys. The supporting shafts are detachably and movably connected to the bottom bar. The pulleys are rotatably and respectively connected to the supporting shafts to hold the limbs of the bow. The operating device is mounted on the mounting frame between the supporting shafts and has a holding seat, a rotating rod, a worm wheel, a worm shaft and a crank shaft. The holding seat is mounted securely on the bottom bar. The rotating rod is rotatably connected to the holding seat. The worm wheel is mounted securely around the rotating rod. The worm shaft is rotatably connected to the holding seat and engages the worm wheel. The crank shaft is connected securely to the worm shaft. The connecting belt is connected to the rotating rod of the operating device to mount around the bow.

Other objects, advantages and novel features of the invention will become more apparent from the following detailed description when taken in conjunction with the accompanying drawings.

DETAILED DESCRIPTION OF PREFERRED EMBODIMENT

Figure 1:
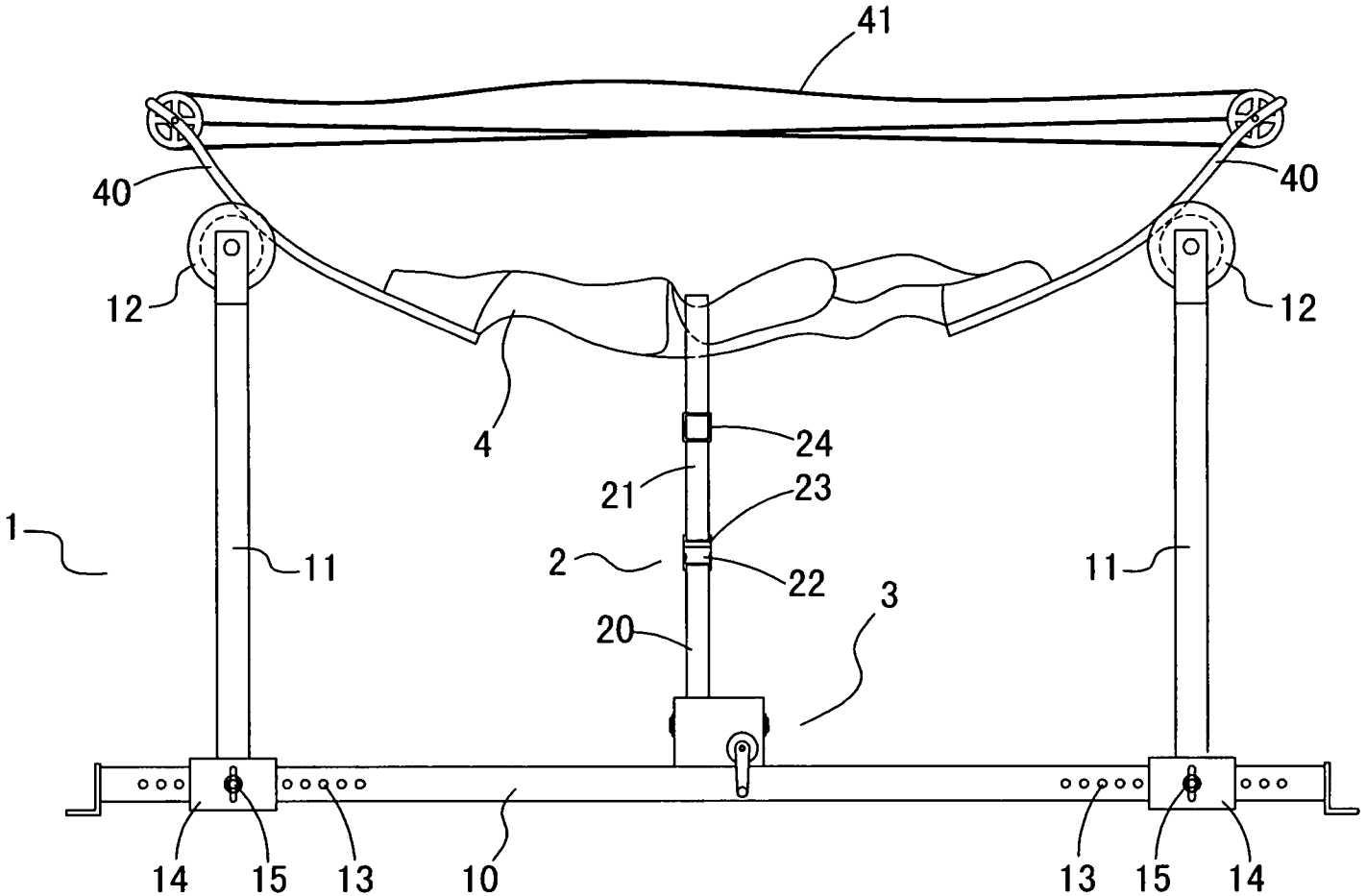
FIG. 1 is a front side view of a first embodiment of a bowstring drawing assembly for a bow in accordance with the present invention.
Figure 2:
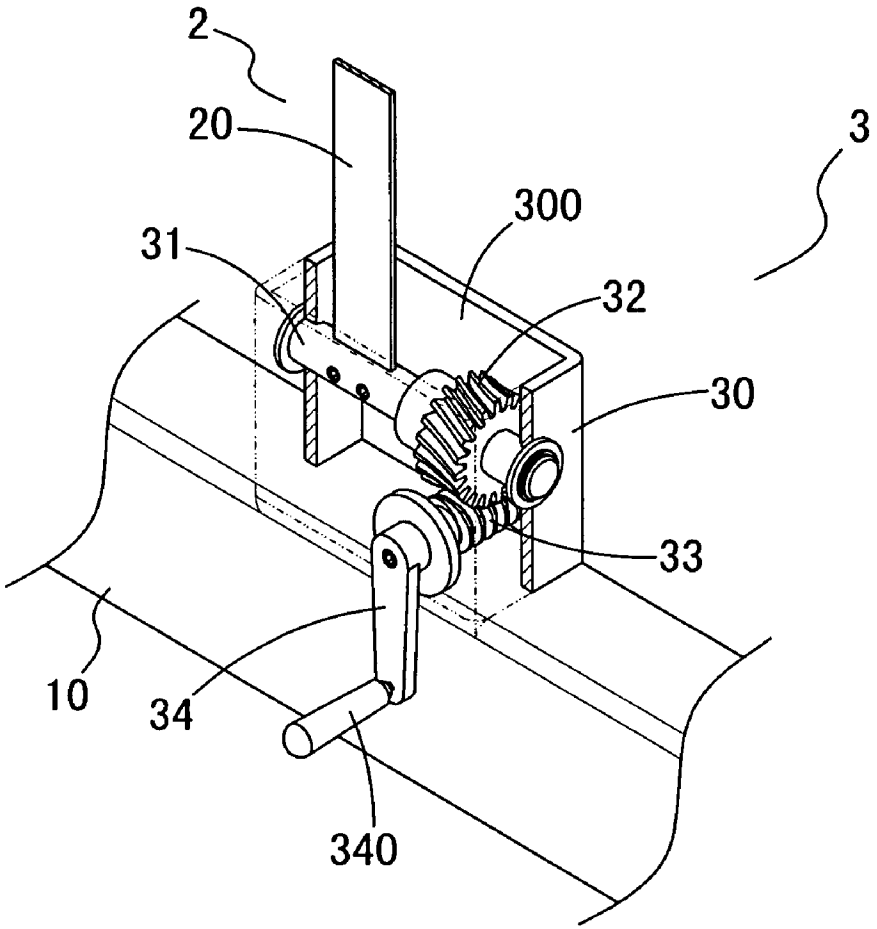
FIG. 2 is an enlarged perspective view of an operating device of the bowstring drawing assembly for a bow in FIG. 1.
Figure 4:
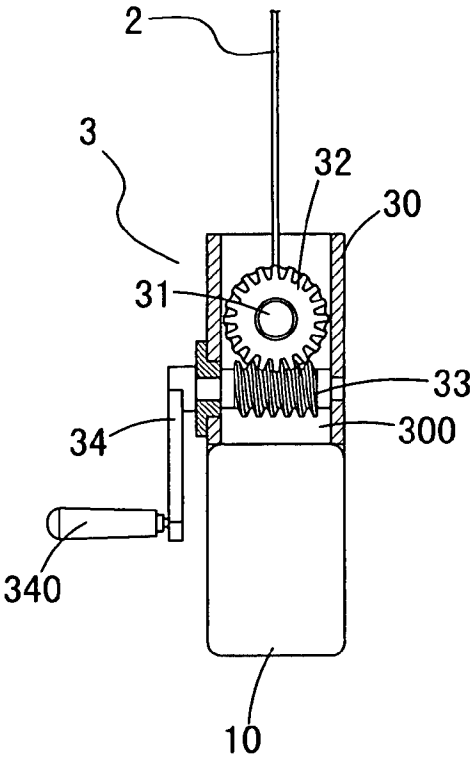
FIGS. 4 and 5 are enlarged side views in partial section of the operating device of the bowstring drawing assembly for a bow in FIG. 1.
Figure 3:
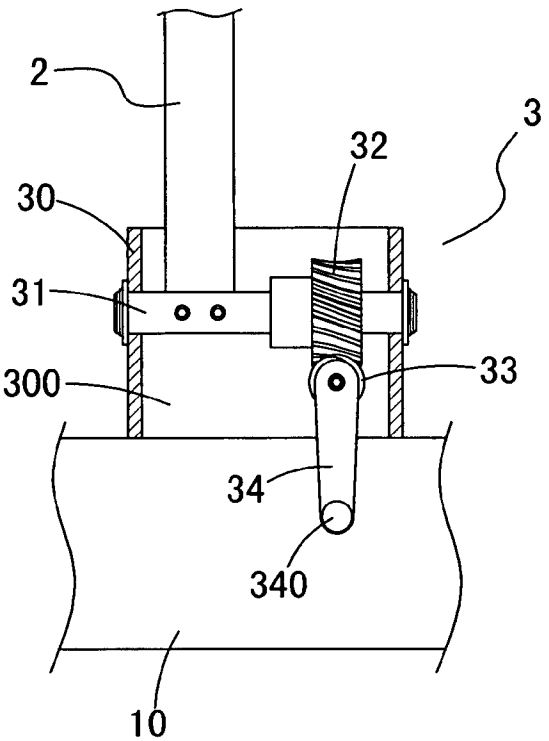
FIG. 3 is an enlarged front side view in partial section of the operating device of the bowstring drawing assembly for a bow in FIG. 1.
Figure 5:
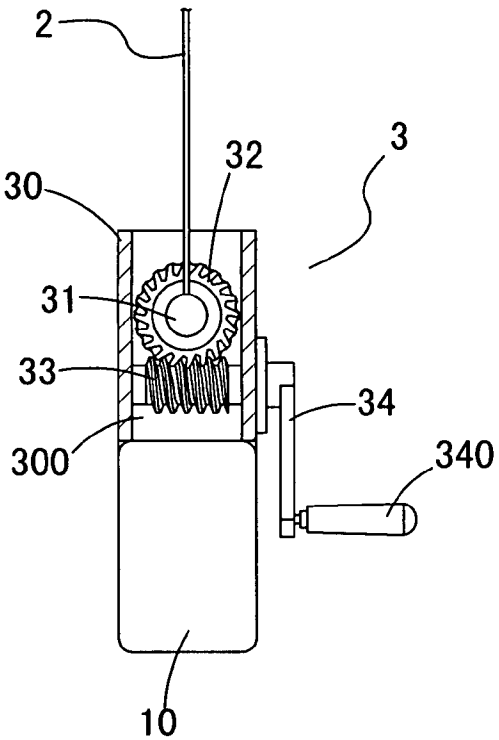

With reference to FIGS. 1 to 5, a bowstring drawing assembly in accordance with the present invention for a bow (4) having two limbs (40) and a bowstring (41) connected to the limbs (40) and the bowstring drawing assembly comprises a mounting frame (1), an operating device (3) and a connecting belt (2).

The mounting frame (1) has a bottom bar (10), two supporting shafts (11) and two pulleys (12).

The bottom bar (10) can be mounted securely on the ground by a fixed device (not shown) and has a top side, two ends, two opposite sides and multiple positioning holes (13). The positioning holes (13) are formed through the opposite sides of the bottom bar (10) at intervals near the ends of the bottom bar (10).

The supporting shafts (11) are detachably and movably connected to the bottom bar (10) and each supporting shaft (11) has an upper end, a lower end, a bar jacket (14) and a positioning pin (15). The bar jacket (14) is formed on the lower end of the supporting shaft (11) and is mounted around the bottom bar (10). The positioning pin (15) is extended through the bar jacket (14) and is mounted in one of the positioning holes (13) near one of the ends of the bottom bar (10) to hold the supporting shaft (11) securely with the bottom bar (10).

The pulleys (12) are rotatably and respectively connected to the upper ends of the supporting shafts (11) to hold the limbs (40) of the bow (4).

The operating device (3) is mounted on the mounting frame (1) between the supporting shafts (11) and has a holding seat (30), a rotating rod (31), a worm wheel (32), a worm shaft (33) and a crank shaft (34).

The holding seat (30) is hollow, is mounted securely on the bottom bar (10) between the supporting shafts (11) and has a top side, a front side, a rear side, two sidewalls, an opening and a mounting recess (300). The front side, the rear side and the sidewalls of the holding seat (30) are mounted on the top side of the bottom bar (10). The sidewalls are formed with the front side and the rear side of the holding seat (30). The opening is formed on the top side of the holding seat (30). The mounting recess (300) is formed in the holding seat (30) and communicates with the opening.

The rotating rod (31) is rotatably connected to the holding seat (30) in the mounting recess (300) and has a proximal end and a distal end. The ends of the rotating rod (31) are respectively connected to the sidewalls of the holding seat (30).

The worm wheel (32) is mounted securely around the rotating rod (31) near the distal end in the mounting recess (300) of the holding seat (30).

The worm shaft (33) is rotatably connected to the holding seat (30) below the rotating rod (31) at an angle of 90°, engages the worm wheel (32) and has a front end and a rear end. The ends of the worm shaft (33) are rotatably connected to the front side and the rear side of the holding seat (30). The front end of the worm shaft (33) is extended out of the front side of the holding seat (30).

The crank shaft (34) is connected securely to the worm shaft (33) and has a connecting end, an operating end and a handle (340). The connecting end of the crank shaft (34) is connected securely to the front end of the worm shaft (33). The handle (340) is formed on the operating end of the crank shaft (34) to rotate the worm shaft (33).

The connecting belt (2) may be a woven belt, is connected to the operating device (3) and has a first segment (20) and a second segment (21).

The first segment (20) is connected to the rotating rod (31) of the operating device (3) and has a lower end, an upper end and a box (22). The lower end of the first segment (20) is connected securely to the rotating rod (31) near the proximal end opposite to the worm wheel (32). The upper end of the first segment (20) is extended out of the opening of the holding seat (30). The box (22) is formed on the upper end of the first segment (20).

The second segment (21) is detachably connected to the first segment (20) and has a lower end, an upper end, a pin thread (23) and an adjusting retainer (24). The lower end of the second segment (21) is connected to the upper end of the first segment (20). The upper end of the second segment (21) is mounted around the bow (4) between the limbs (40). The pin thread (23) is formed on the lower end of the second segment (21) and is connected to the box (22) of the first segment (20). The adjusting retainer (24) is mounted around the second segment (21) between the ends of the second segment (21) and the upper end of the second segment (21) is connected to the adjusting retainer (24) to adjust the length of the connecting belt (2). In preferred, a clasp or a fastener can be formed on the upper end of the second segment (21) to catch on or adhesive on the bow (4).

Figure 9:
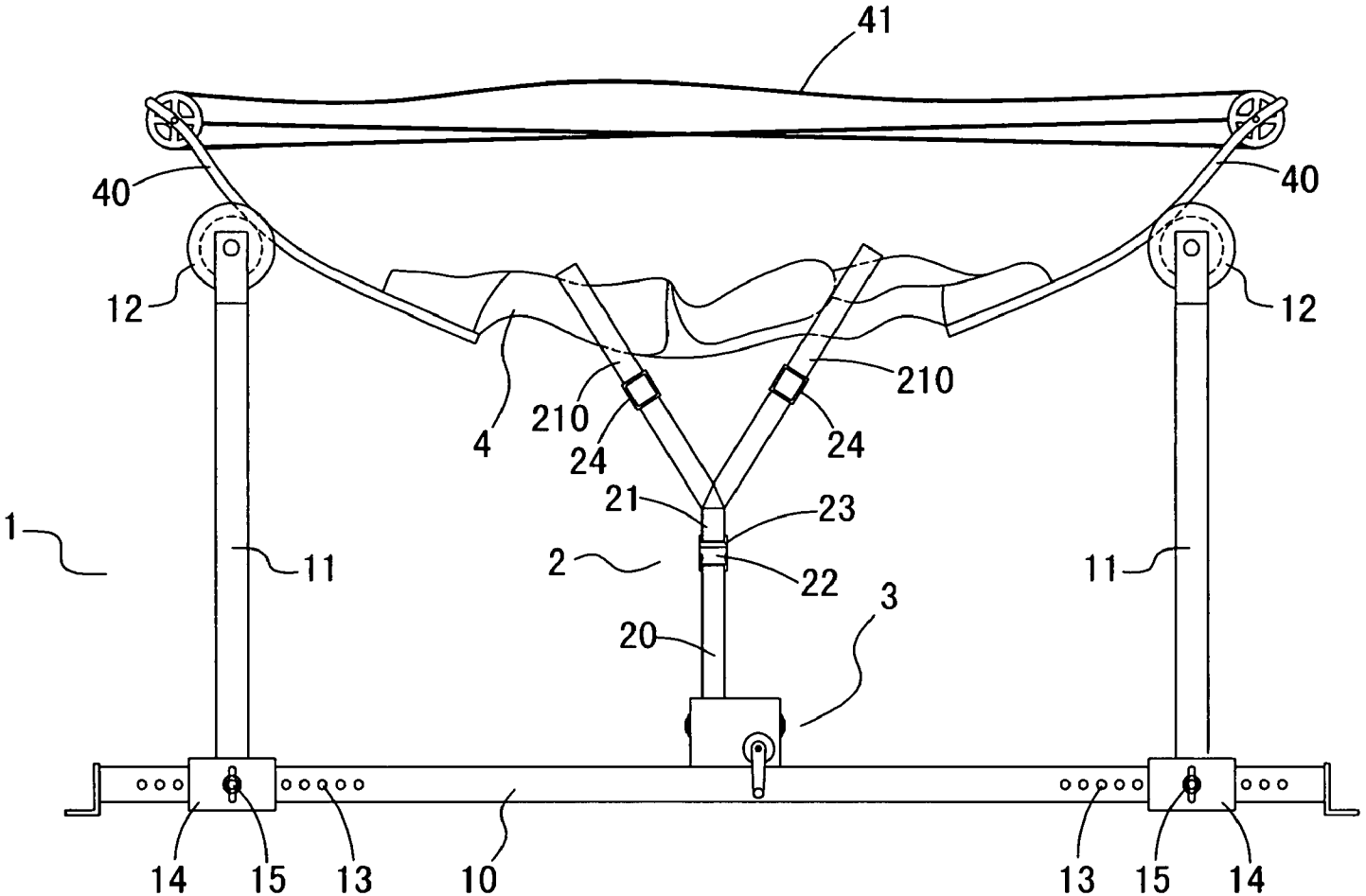
FIG. 9 is a front side view of a second embodiment of a bowstring drawing assembly for a bow in accordance with the present invention.

With reference to FIG. 9, the second segment (21) further has multiple extending segments (210) formed on the upper end of the second segment (21) to mount around the bow (4) to provide a uniform holding effect and each extending segment (210) has an adjusting retainer (24). In preferred, there are two extending segments (210) formed on the upper end of the second segment (21).

Figure 7:
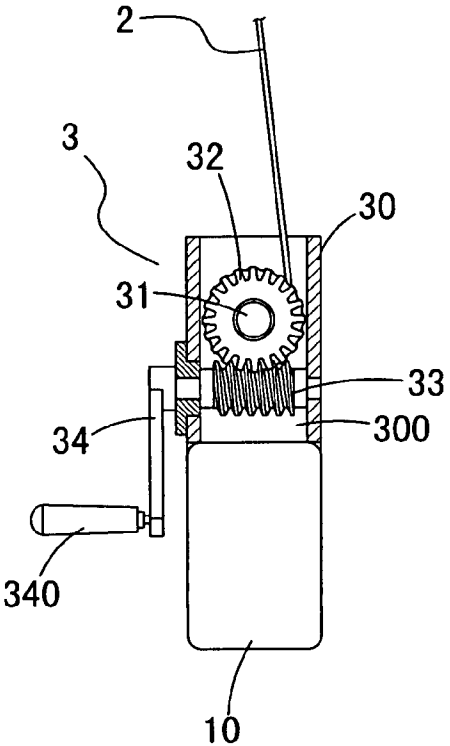
FIGS. 7 and 8 are operational side views in partial section of the operating device of the bowstring drawing assembly for a bow in FIG. 1.
Figure 6:
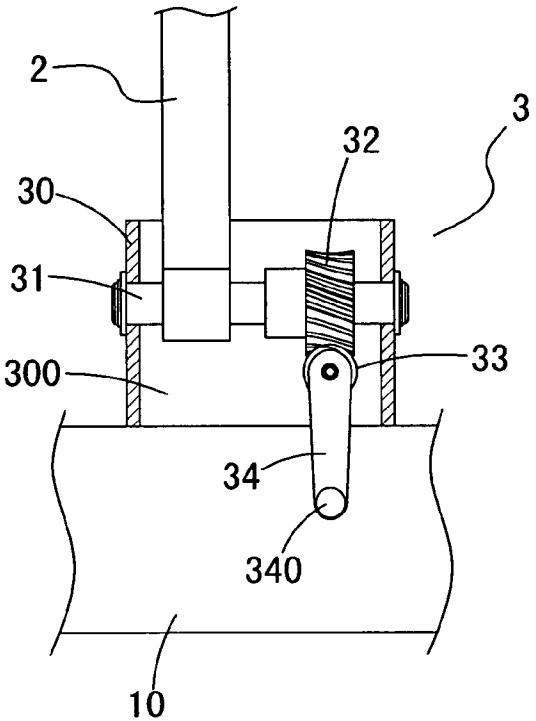
FIG. 6 is an operational front side view in partial section of the operating device of the bowstring drawing assembly for a bow in FIG. 1.
Figure 8:
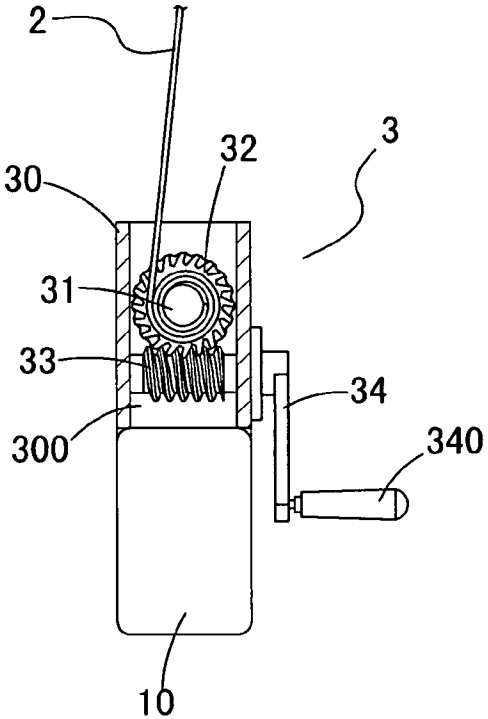

With reference to FIGS. 6 to 8, when using the bowstring drawing assembly in accordance with the present invention to adjust the bowstring (41) of the bow (4), putting the limbs (40) of the bow (4) respectively on the pulleys (12) of the mounting frame (1) and mounting the second segment (21) securely around the bow (4) between the limbs (40) by the adjusting retainer (24). Then, rotating the handle (340) of the crank shaft (34), the worm shaft (33) in the mounting recess (300) of the holding seat (30) will rotate with the crank shaft (34) relative to the holding seat (30) and the worm wheel (32) will rotate with the worm shaft (33) by the engagement of the worm wheel (32) and the worm shaft (33). When the worm wheel (32) rotates with the worm shaft (33) relative to the holding seat (30) and the rotating rod (31) will rotate with the worm wheel (32) to let the lower end of the first segment (20) of the connecting belt (2) winding around the rotating rod (31). Then, the second segment (21) of the connecting belt (2) will pull the middle of the bow (4) downward. As the middle of the bow (4) is pulled downward by the connecting belt (2), the limbs (40) of the bow (4) will be bent between the pulleys (12) and the bowstring (41) between the limbs (40) can be adjusted or replaced easily and conveniently.

The bowstring drawing assembly for a bow as described has the following advantages.

1. The simplified design of the bowstring drawing assembly in accordance with the present invention causes the manufacturing and assembling to be cheaper and quicker, especially the design of the connecting belt (2).

2. The engagement between the worm wheel (32) and the worm shaft (33) of the operating device (30) can provide a labor-saving and non-return effect.

3. When using the bowstring drawing assembly in accordance with the present invention to adjust or replace the bowstring (41) of the bow (4), the user only needs to mount the connecting belt (2) around the bow (4) and rotate the handle (340) of the crank shaft (34) and this is convenient in used.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bowstring drawing assembly for a bow having two limbs and a bowstring, the bowstring drawing assembly comprising:

a mounting frame having a bottom bar having a top side;

two ends; and two opposite sides;

two supporting shafts detachably and movably connected to the bottom bar and each supporting shaft having an upper end; and a lower end connected to the bottom bar near one of the ends of the bottom bar; and two pulleys rotatably and respectively connected to the upper ends of the supporting shafts to hold the limbs of the bow;

an operating device mounted on the mounting frame between the supporting shafts and having a holding seat being hollow, mounted securely on the bottom bar between the supporting shafts and having a top side;

a front side mounted on the top side of the bottom bar;

a rear side mounted on the top side of the bottom bar; and two sidewalls mounted on the top side of the bottom bar and formed with the front side and the rear side of the holding seat;

a rotating rod rotatably connected to the holding seat and having a proximal end; and a distal end;

wherein the ends of the rotating rod respectively connected to the sidewalls of the holding seat;

a worm wheel mounted securely around the rotating rod near the distal end in the holding seat;

a worm shaft rotatably connected to the holding seat, engaging the worm wheel and having a front end rotatably connected to and extended out of the front side of the holding seat; and a rear end rotatably connected to the rear side of the holding seat; and a crank shaft connected securely to the worm shaft and having a connecting end connected securely to the front end of the worm shaft; and an operating end formed with the connecting end; and a connecting belt connected to the rotating rod of the operating device to mount around the bow between the limbs.

2. The bowstring drawing assembly for a bow as claimed in claim 1, wherein the holding seat has an opening formed on the top side of the holding seat; and a mounting recess formed in the holding seat and communicating with the opening;

the rotating rod is rotatably connected to the holding seat in the mounting recess;

the worm wheel is mounted securely around the rotating rod in the mounting recess of the holding seat; and the connecting belt is extended out of the opening of the holding seat.

3. The bowstring drawing assembly for a bow as claimed in claim 2, wherein the crank shaft has a handle formed on the operating end of the crank shaft to rotate the worm shaft.

4. The bowstring drawing assembly for a bow as claimed in claim 3, wherein the connecting belt has at least one adjusting retainer to adjust the length of the connecting belt.

5. The bowstring drawing assembly for a bow as claimed in claim 4, wherein the bottom bar has multiple positioning holes formed through the opposite sides of the bottom bar at intervals near the ends of the bottom bar; and each supporting shaft has a bar jacket formed on the lower end of the supporting shaft and mounted around the bottom bar; and a positioning pin extended through the bar jacket and mounted in one of the positioning holes near one of the ends of the bottom bar to hold the supporting shaft securely with the bottom bar.

6. The bowstring drawing assembly for a bow as claimed in claim 5, wherein the connecting belt has a first segment connected to the rotating rod of the operating device and having a lower end connected securely to the rotating rod near the proximal end opposite to the worm wheel;

an upper end extended out of the opening of the holding seat; and a box formed on the upper end of the first segment; and a second segment detachably connected to the first segment and having a lower end connected to the upper end of the first segment;

an upper end mounted around the bow between the limbs; and a pin thread formed on the lower end of the second segment and connected to the box of the first segment.

7. The bowstring drawing assembly for a bow as claimed in claim 5, wherein the connecting belt has a first segment connected to the rotating rod of the operating device and having a lower end connected securely to the rotating rod near the proximal end opposite to the worm wheel;

an upper end extended out of the opening of the holding seat; and a box formed on the upper end of the first segment; and a second segment detachably connected to the first segment and having a lower end connected to the upper end of the first segment;

an upper end mounted around the bow between the limbs;

a pin thread formed on the lower end of the second segment and connected to the box of the first segment; and multiple extending segments formed on the upper end of the second segment to mount around the bow.

* * * * *